US010274885B2

(12) United States Patent
Hirata et al.

(10) Patent No.: US 10,274,885 B2
(45) Date of Patent: Apr. 30, 2019

(54) IMAGE FORMING APPARATUS HAVING MULTIPLE IMAGE FORMING MODES

(71) Applicant: CANON KABUSHIKI KAISHA, Tokyo (JP)

(72) Inventors: Yuichiro Hirata, Susono (JP); Daisuke Baba, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/009,585

(22) Filed: Jun. 15, 2018

(65) Prior Publication Data

US 2018/0292778 A1 Oct. 11, 2018

Related U.S. Application Data

(63) Continuation of application No. 15/429,441, filed on Feb. 10, 2017, now Pat. No. 10,031,461.

(30) Foreign Application Priority Data

Feb. 19, 2016 (JP) ..... 2016-030184

(51) Int. Cl.
*G03G 15/08* (2006.01)
*G03G 15/00* (2006.01)

(52) U.S. Cl.
CPC ..... *G03G 15/556* (2013.01)

(58) Field of Classification Search
CPC ..... G03G 15/556; G03G 15/08
See application file for complete search history.

(56) References Cited

U.S. PATENT DOCUMENTS

| | | | | |
|---|---|---|---|---|
| 7,215,904 | B2 | 5/2007 | Hasegawa et al. | |
| 9,170,527 | B2 * | 10/2015 | Ariizumi | G03G 15/0877 |
| 2004/0141765 | A1 * | 7/2004 | Shimura | G03G 15/5041 399/49 |
| 2004/0208657 | A1 | 10/2004 | Kakeshita et al. | |
| 2009/0269094 | A1 * | 10/2009 | Mitsui | G03G 15/0856 399/53 |

(Continued)

FOREIGN PATENT DOCUMENTS

| | | | |
|---|---|---|---|
| JP | H08-227222 | A | 9/1996 |
| JP | 3309306 | B2 | 7/2002 |

(Continued)

*Primary Examiner* — Francis C Gray
(74) *Attorney, Agent, or Firm* — Venable LLP

(57) ABSTRACT

An image forming apparatus includes an image bearing member, a developer bearing member, an updating device to update toner consumption based on a number of dots corresponding to laser irradiation by which toner is consumed, and an alerting device to alert an alarm concerning a residual amount of the toner based on toner consumption updated by the updating device. Image formation is performed in a first mode at a first peripheral speed ratio representing a ratio of a peripheral speed of the developer bearing member to a peripheral speed of the image bearing member, and in a second mode at a second peripheral speed ratio, which is greater than the first peripheral speed ratio. The alerting device alerts the alarm based on a total number of dots, which is smaller as an operation frequency of the second mode and becomes higher in an operation frequency of the first mode.

6 Claims, 13 Drawing Sheets

(56) References Cited

U.S. PATENT DOCUMENTS

| | | | | |
|---|---|---|---|---|
| 2012/0106991 | A1* | 5/2012 | Fukuda | G03G 15/556 399/27 |
| 2012/0251185 | A1* | 10/2012 | Matsumoto | G03G 15/0893 399/258 |
| 2013/0002791 | A1 | 1/2013 | Yamada | |
| 2017/0242386 | A1* | 8/2017 | Hirata | G03G 15/556 |

FOREIGN PATENT DOCUMENTS

| | | | |
|---|---|---|---|
| JP | 2011-099933 | A | 5/2011 |
| JP | 2013-210489 | A | 10/2013 |

* cited by examiner

FIG.10

| IMAGE DENSITY SIGNAL | TONER CONSUMPTION PER UNIT N |
|---|---|
| 0～20% | 1.1 |
| 20～40% | 1.3 |
| 40～60% | 1.5 |
| 60～80% | 1.7 |
| 80～100% | 2 |

FIG.11

| IMAGE DENSITY SIGNAL | TONER CONSUMPTION PER UNIT N |
|---|---|
| 0～25% | 1.15 |
| 25～50% | 1.2 |
| 50～75% | 1.45 |
| 75～100% | 1.75 |

IMAGE FORMING APPARATUS HAVING MULTIPLE IMAGE FORMING MODES

This application is a continuation of application Ser. No. 15/429,441, filed Feb. 10, 2017.

BACKGROUND OF THE INVENTION

Field of the Invention

The present invention relates to an image forming apparatus that forms an image on a recording medium using a developer.

Description of the Related Art

Conventionally, there have been known in-line color system image forming apparatuses that primarily transfer toner images from a plurality of process cartridges onto an intermediate transfer belt to form an image on a sheet. In such image forming apparatuses, electrostatic latent images formed on photosensitive drums are developed by developing apparatuses to form toner images on the photosensitive drums in a plurality of process cartridges. Further, the toner images formed on the photosensitive drums are primarily transferred onto an intermediate transfer belt, and the toner images primarily transferred onto the intermediate transfer belt are then secondarily transferred onto a sheet. After that, the toner images secondarily transferred onto the sheet are heated and pressed by a fixing apparatus to be fixed onto the sheet. Thus, a color image is formed on the sheet.

Here, the image formed on the sheet needs to have a tinge and density as intended by a user. In addition, in color images formed by color image forming apparatuses, high tinge accuracy and tinge stability become important. Therefore, according to a technology disclosed in Japanese Patent Application Laid-open No. H8-227222, a bias applied to a developing roller and a rotation speed of the developing roller are changed to obtain a desired image tinge and image density. For example, the bias applied to the developing roller is increased to increase density of a toner image formed on a photosensitive drum and change a tinge of an image. In addition, the rotation speed of the developing roller is decreased to increase density of a toner image formed on the photosensitive drum and change a tinge of an image.

Further, according to a technology disclosed in Japanese Patent Application Laid-open No. 2013-210489, a rotation speed of a photosensitive drum is made slower than that of a developing roller to prevent rough feelings on an image formed on a sheet. In addition, magnetic flux density of a magnet provided inside the developing roller is increased to prevent a resin carrier from adhering to the photosensitive drum and prevent a problem from occurring in an image formed on the sheet.

Conventionally, as a method for detecting a residual amount of toner inside a developing apparatus, there has been known a method for detecting a residual amount of toner using image information received by an image forming apparatus. Specifically, first, the number of dots developed as a toner image may be acquired from image information (digital data) received by the image forming apparatus. Further, the number of the developed dots may be multiplied by an amount of the toner consumed to develop one dot to calculate an amount of the toner consumed by one image. Further, the amount of the consumed toner may be subtracted from a residual amount of the toner inside the developing apparatus to derive a residual amount of the toner after an image forming operation. Here, the amount of the toner consumed to develop one dot is stored in advance in a storage medium such as a memory.

However, the amount of the toner consumed to develop one dot changes when the bias applied to the developing roller and the rotation speed of the developing roller are changed as disclosed in Japanese Patent Application Laid-open No. H8-227222 and Japanese Patent Application Laid-open No. 2013-210489. Therefore, the amount of the toner consumed to form one image also changes, which results in an error in the residual amount of the toner after the image forming operation.

SUMMARY OF THE INVENTION

The present invention has an object of accurately acquiring a consumption amount of a developer such as toner.

The present invention has another object of providing an image forming apparatus comprising:

- an image bearing member on which an electrostatic image is formed; and
- a developer bearing member that bears a developer to develop the electrostatic image formed on the image bearing member,
- wherein the image forming apparatus is capable of performing
- a first image forming mode that performs image formation at a first peripheral speed ratio representing a ratio of a peripheral speed of the developer bearing member to a peripheral speed of the image bearing member and
- a second image forming mode that performs the image formation at a second peripheral speed ratio, which is different from the first peripheral speed ratio,
- wherein an amount of the developer consumed in the image formation is detected based on an estimate of an amount of the developer consumed by one pixel and the number of pixels at a part at which the developer is consumed, and
- wherein the estimate of the amount of the developer consumed by the one pixel in the first image forming mode is different from that in the second image forming mode.

According to an embodiment of the present invention, it is possible to accurately acquire a consumption amount of a developer such as toner.

Further features of the present invention will become apparent from the following description of exemplary embodiments with reference to the attached drawings.

BRIEF DESCRIPTION OF THE DRAWINGS

FIG. 10 is a diagram showing the relationship between the image density signal and toner consumption N per unit in the second embodiment;

FIG. 11 is a diagram showing the relationship between the image density signal and the toner consumption N per unit in the third embodiment;

DESCRIPTION OF THE EMBODIMENTS

Modes for carrying out the present invention are illustratively explained in detail below on the basis of the embodiments with reference to the drawings. However, dimensions, materials, and shapes of components described in the embodiments, relative arrangement of the components, and the like should be changed as appropriate according to the configuration of an apparatus to which the invention is applied and various conditions. That is, the dimensions, the materials, the shapes, and the relative arrangement are not intended to limit the scope of the present invention to the embodiments.

First Embodiment (Entire Configuration of Image Forming Apparatus)

Figure 1:
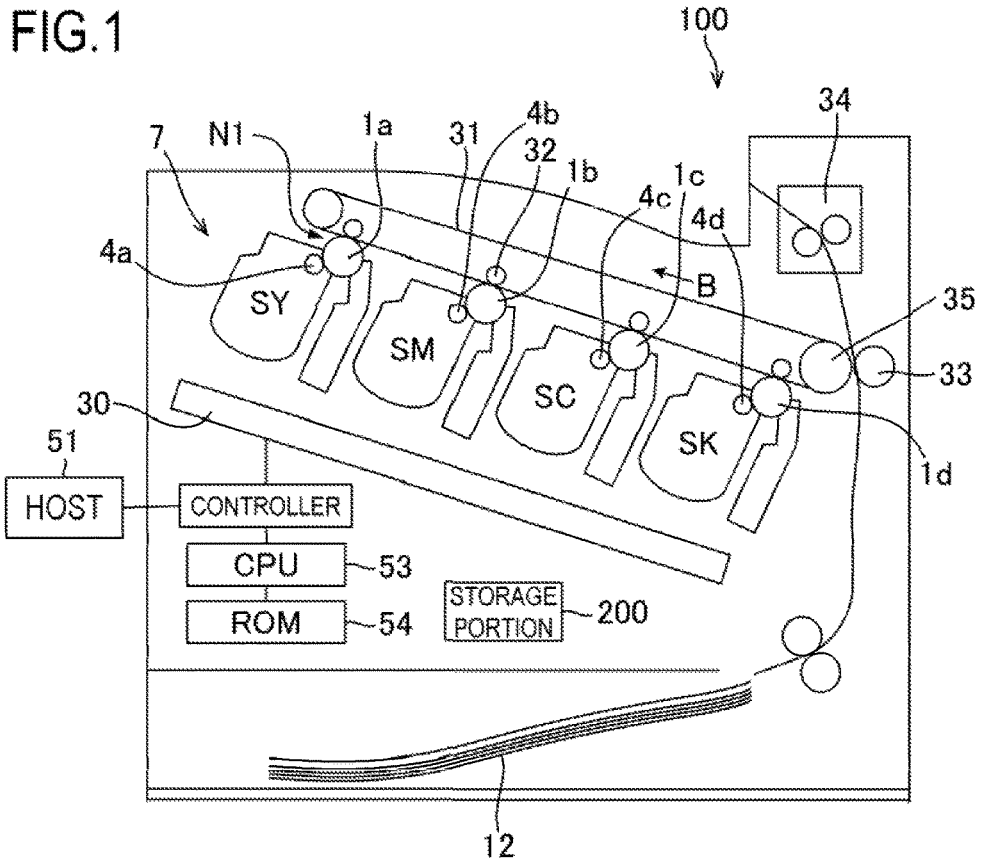
FIG. 1 is a schematic configuration cross-sectional view of an image forming apparatus in a first embodiment.

First, a description will be given of the entire configuration of an electrophotographic image forming apparatus 100 (image forming apparatus 100) according to an embodiment. FIG. 1 is a schematic cross-sectional view of the image forming apparatus 100 according to the embodiment. The image forming apparatus 100 of the embodiment is a full-color laser printer using an in-line system and an intermediate transfer system. The image forming apparatus 100 is capable of forming a full-color image on a recording material (for example, a recording sheet, a plastic sheet, a fabric, or the like) according to image information received by the image forming apparatus 100. The image information is input to the image forming apparatus 100 from an image reading apparatus connected to the image forming apparatus 100, a host device such as a personal computer communicably connected to the image forming apparatus 100, or the like.

The image forming apparatus 100 has, as a plurality of image forming portions, first to fourth image forming portions SY, SM, SC, and SK that form images of the colors of yellow (Y), magenta (M), cyan (C), and black (K), respectively. In the embodiment, the first to fourth image forming portions SY to SK are arranged in a line in a direction crossing a vertical direction. In the embodiment, the configurations and operations of the first to fourth image forming portions SY to SK are substantially the same except that the colors of formed images are different from each other. Accordingly, suffixes Y, M, C, and K of symbols will be omitted below so long as it is not necessary to particularly distinguish the configurations and operations of the first to fourth image forming units SY to SK from each other.

In the embodiment, all process cartridges 7 (7Y to 7K) for the respective colors have the same shape, and toner of the respective colors of yellow (Y), magenta (M), cyan (C), and black (K) is accommodated in the process cartridges 7 for the respective colors. In addition, the process cartridges 7 have an intermediate transfer belt 31 serving as means for transferring toner images developed by toner 10 serving as a developer in the process cartridges 7. The intermediate transfer belt 31 is a belt formed of an endless belt, comes in contact with all photosensitive drums 1 (1*a* to 1*d*) serving as image bearing members, and circularly moves in a direction (counterclockwise direction) indicated by arrow B in FIG. 1. The intermediate transfer belt 31 is stretched over between a driver roller (not shown), a secondary transfer facing roller (not shown), and a driven roller (not shown) serving as a plurality of support members.

In addition, on the side of the inner peripheral surface of the intermediate transfer belt 31, four primary transfer rollers 32 (32Y to 32K) serving as primary transfer means are arranged side by side in a line at positions facing the respective photosensitive drums 1. The primary transfer rollers 32 press the intermediate transfer belt 31 toward the photosensitive drums 1 to form primary transfer portions N1 at which the intermediate transfer belt 31 and the photosensitive drums 1 come in contact with each other. Further, a bias having polarity opposite to the normal charged polarity of the toner is applied from a primary transfer bias power supply (high pressure power supply) (not shown) serving as primary transfer applying means to the primary transfer rollers 32. Thus, the toner images on the photosensitive drums 1 (image bearing members) are transferred (primarily transferred) onto the intermediate transfer belt 31.

In addition, at a position facing a secondary transfer facing roller 35 on the side of the outer peripheral surface of the intermediate transfer belt 31, a secondary transfer roller 33 serving as secondary transfer means is arranged. The secondary transfer roller 33 presses against the secondary transfer facing roller 35 via the intermediate transfer belt 31 to form a secondary transfer portion at which the intermediate transfer belt 31 and the secondary transfer roller 33 come in contact with each other. Further, a bias having polarity opposite to the normal charged potential of the toner is applied from a secondary transfer bias power supply (high pressure power supply) (not shown) serving as secondary transfer bias applying means to the secondary transfer roller 33. Thus, the toner images on the intermediate transfer belt 31 are transferred (secondarily transferred) onto a recording material 12.

As a further description, first of all, the surfaces of the photosensitive drums 1 serving as image bearing members are uniformly charged by charging rollers 2 during image formation. Next, laser light corresponding to image information is irradiated by a scanner unit 30 (exposure member) to scan and expose the surfaces of the charged photosensitive drums 1, whereby electrostatic images corresponding to the image information are formed on the photosensitive drums 1. Then, the electrostatic images formed on the photosensitive drums 1 are developed as toner images by developing units 3 serving as developing apparatuses. The toner images formed on the photosensitive drums 1 are transferred (primarily transferred) onto the intermediate transfer belt 31 by the operation of the primary transfer rollers 32.

For example, when a full-color image is formed, the above processes are successively performed in the first to fourth image forming portions SY to SK, whereby toner images of the respective colors are primarily transferred onto the intermediate transfer belt 31 so as to overlap each other. Then, the recording material 12 is conveyed to the secondary transfer portion in synchronization with the movement of the intermediate transfer belt 31. The toner images of the four colors on the intermediate transfer belt 31 are collectively secondarily transferred onto the recording material 12 by the operation of the secondary transfer roller 33 coming in contact with the intermediate transfer belt 31 via the recording material 12.

The recording material 12 onto which the toner images have been transferred is conveyed to a fixing apparatus 34 serving as fixing means. When heat and pressure are applied onto the recording material 12 in the fixing apparatus 34, the toner images are fixed onto the recording material 12. In addition, primarily untransferred toner on the photosensitive drums 1 after the primary transfer process is removed and collected by cleaning members 6 (see FIG. 2). In addition, secondarily untransferred toner on the intermediate transfer belt 31 after the secondary transfer process is cleaned by an intermediate transfer belt cleaning device (not shown). Note that the image forming apparatus 100 is also capable of forming a monochromatic or multicolor image using a desired one or some of (not every one of) the image forming portions.

Figure 13:
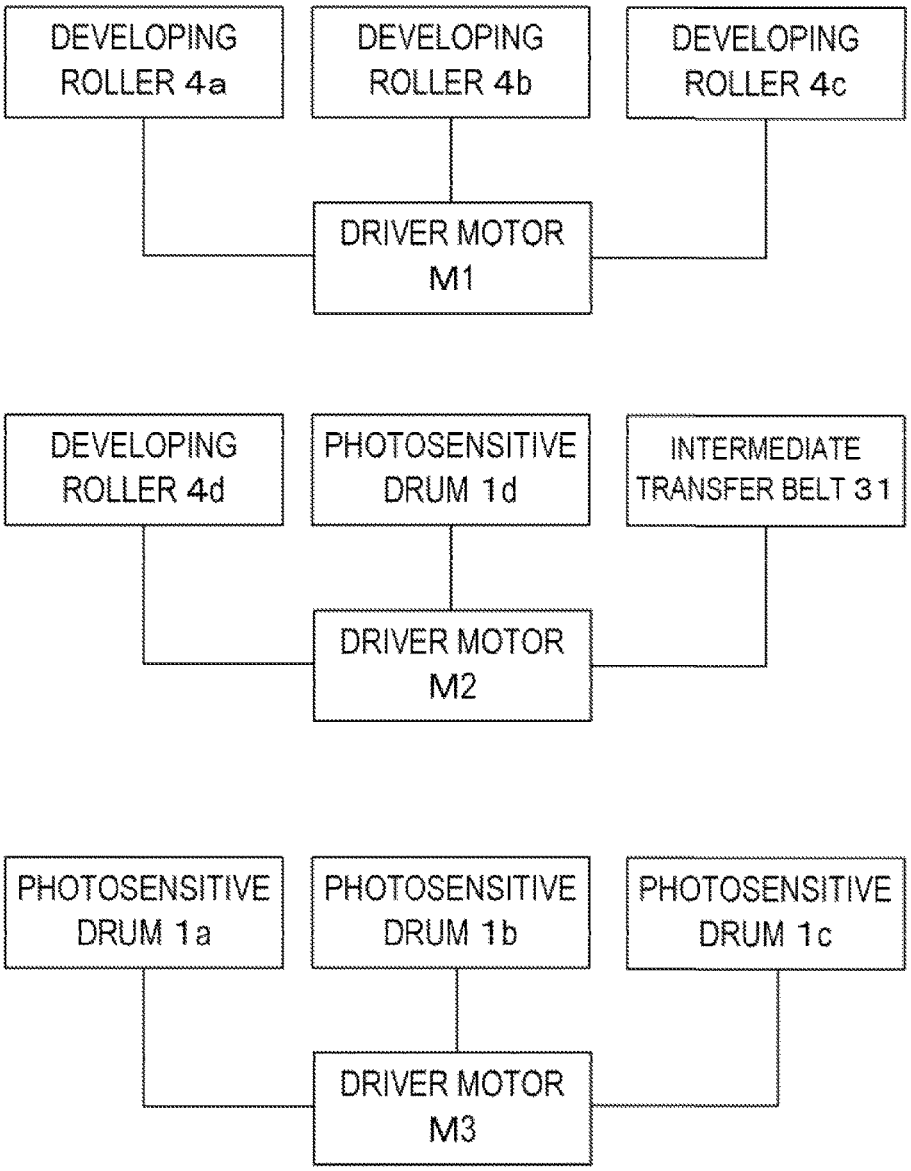
FIG. 13 is a hardware configuration diagram showing drive transmission paths from drive motors.

Here, FIG. 13 is a hardware configuration diagram showing drive transmission paths from drive motors M1 to M3 serving as drive sources. In the embodiment, as shown in FIG. 13, developing rollers 4*a*, 4*b*, and 4*c* serving as developer bearing members are driven by the same drive motor M1. In addition, a developing roller 4*d*, the photosensitive drum 1*d*, and the intermediate transfer belt 31 are driven by the same drive motor M2. In addition, the photosensitive drums 1*a*, 1*b*, and 1*c* are driven by the same drive motor M3. In the embodiment, the photosensitive drum 1*d* contacting (facing) the developing roller 4*d* is, for example, driven by the different drive motor. Thus, since it is possible to change peripheral speeds (movement speeds of the surfaces) of the developing rollers and peripheral speeds (movement speeds of the surfaces) of the photosensitive drums, image formation may be performed in a mode in which a peripheral speed ratio is different.

(Configuration of Process Cartridges)

Figure 2:
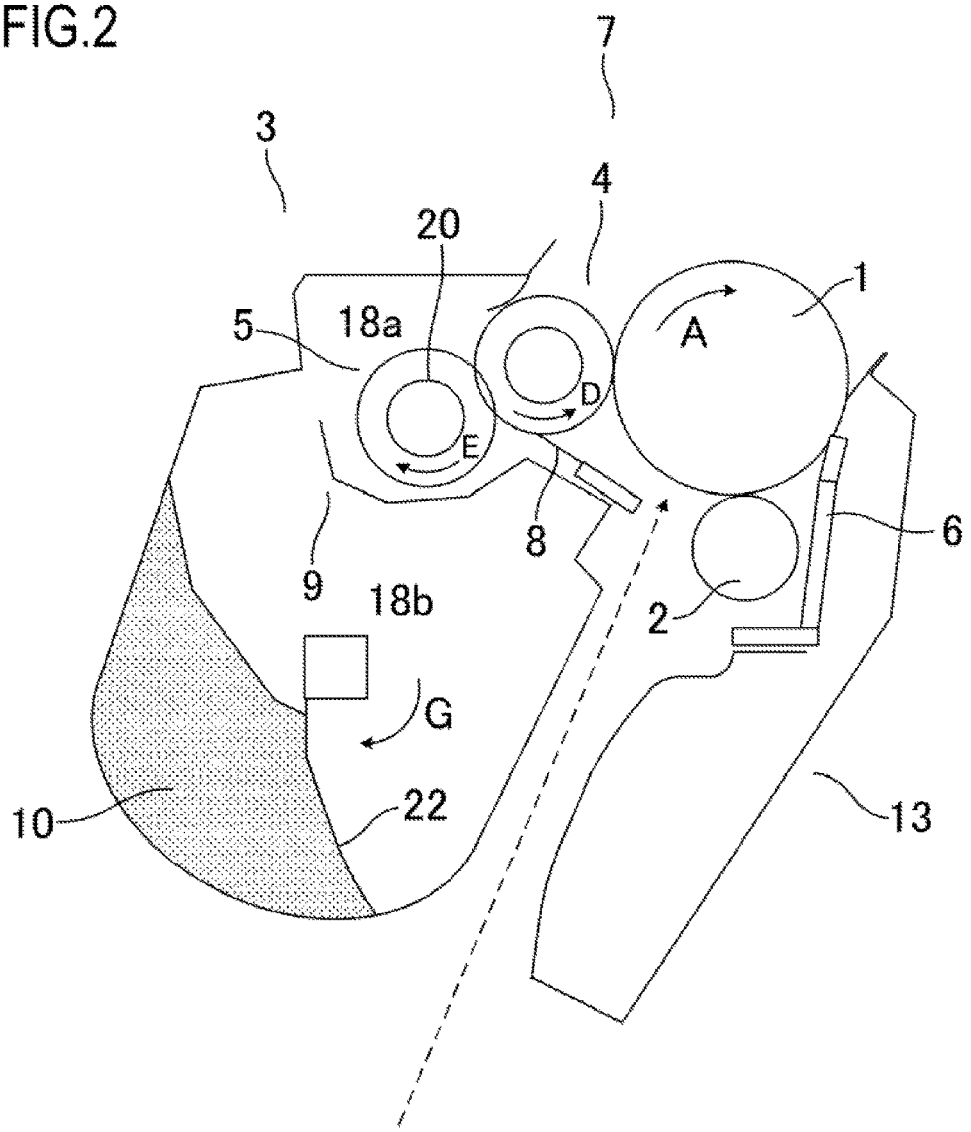
FIG. 2 is a schematic cross-sectional view of a process cartridge in the first embodiment.

Next, a description will be given, with reference to FIG. 2, of the entire configuration of the process cartridges 7 attached to the image forming apparatus 100 of the embodiment. In the embodiment, the configurations and operations of the process cartridges 7 for the respective colors are substantially the same except for the types (colors) of accommodated toner. FIG. 2 is a schematic cross-sectional view (main cross-sectional view) of one of the process cartridges 7 when seen along the longitudinal direction (rotational central axis line direction) of the photosensitive drum 1. The posture of the process cartridge 7 shown in FIG. 2 is adopted when the process cartridge 7 is attached to the image forming apparatus 100. The positional relationships, directions, and the like, of the respective components of the process cartridge 7 that will be described later are based on positional relationships and directions where the process cartridge 7 adopts the posture.

The process cartridge 7 is integrally constituted by a photosensitive unit 13 having the photosensitive drum 1 serving as an image bearing member or the like and the developing unit 3 having the developing roller 4 or the like. The photosensitive drum 1 is rotatably attached to the photosensitive unit 13 via a bearing not shown. The photosensitive drum 1 rotates and drives in a (clockwise) direction indicated by arrow A in FIG. 2 according to an image forming operation when a drive force is transmitted from a drive motor serving as drive means (drive source) not shown to the photosensitive unit 13. Note that the photosensitive drum 1 has an outer diameter of 24 mm and rotates at 40 rpm. In the embodiment, the photosensitive drum 1 playing a central role in an image forming process is an organic photosensitive drum 1 in which an undercoat layer, a carrier generation layer, and a carrier transfer layer serving as functional films are successively coated on the outer peripheral surface of an aluminum cylinder.

In addition, the photosensitive unit 13 has a cleaning member 6 and a charging roller 2 arranged so as to contact the outer peripheral surface of the photosensitive drum 1. Residual toner removed from the surface of the photosensitive drum 1 by the cleaning member 6 is dropped and accommodated in a waste toner container inside the photosensitive unit 13. The charging roller 2 serving as charging means is formed of a cored bar and conductive rubber covering the outer peripheral surface of the cored bar, and driven to rotate when a roller portion formed of the conductive rubber contacts the photosensitive drum 1.

Here, a prescribed DC voltage is applied to the cored bar of the charging roller 2 in a charging process, whereby a uniform dark potential (Vd) is formed on the surface of the photosensitive drum 1. In addition, a spot pattern of laser light emitted from the scanner unit 30 (exposure member) so as to correspond to image data exposes the photosensitive drum 1, and charges on the surface disappear due to carriers from the carrier generation layer, whereby a potential at a segment exposed by the laser light reduces. As a result, the potential of the exposed segment becomes a prescribed bright potential (Vl), and a potential of an unexposed segment becomes a prescribed dark potential (Vd). Thus, an electrostatic latent image is formed on the photosensitive drum 1. Note that the prescribed dark potential (Vd) is set at −500 V and the prescribed bright potential (Vl) is set at −100 V in the embodiment.

On the other hand, the developing unit 3 serving as a developing apparatus has the developing roller 4 serving as a developer bearing member that bears the toner 10 serving as a developer and a developing chamber 18*a* in which a toner supply roller 20 serving as a supply member that supplies the toner 10 to the developing roller 4 is arranged. Moreover, in the developing unit 3, a toner accommodation portion (developer accommodation portion) 18*b* that accommodates the toner 10 is provided under the toner supply roller 20 in the vertical direction. Note that the toner used in the embodiment has a degree of agglomeration of 5% to 40% in its initial state. In order to ensure the flowability of the toner through a durability test, the toner having such a degree of agglomeration is preferably used. In addition, the degree of agglomeration of the toner was measured as follows.

As a measuring apparatus, a powder tester (manufactured by Hosokawa Micron Corporation) having a digital vibration meter (DIGITAL VIBRATION METER MODEL 1332 manufactured by SHOWA SOKKI CORPORATION) was used. In addition, as a measuring method, a 390-mesh sieve, a 200-mesh sieve, and a 100-mesh sieve were stacked in order and set on a vibration table in a narrowing order of an opening, i.e., the 390-mesh sieve, the 200-mesh sieve, and the 100-mesh sieve were stacked in order and set so as to make the 100-mesh sieve placed on a top side.

5 g of a correctly measured sample (toner) was put on the 100-mesh sieve and adjusted such that a displacement value of the digital vibration meter was set at 0.6 mm (peak-to-peak), and the sieves were vibrated for 15 seconds. After that, the masses of the residual sample on the respective sieves were measured, and the degree of agglomeration was obtained based on the following expression. At this time, the measurement sample was left uncontrolled for 24 hours in a 23° C. and 60% RH (relative humidity) environment in advance, and measured in the 23° C. and 60% RH environment.

Degree of agglomeration (%)=(mass of residual sample on 100-mesh sieve/5 g)×100+(mass of residual sample on 200-mesh sieve/5 g)×60+(mass of residual sample on 390-mesh sieve/5 g)×20

In addition, the toner supply roller 20 forms, while rotating, a nip portion (portion at which the toner is held by the developing roller 4 and the toner supply roller 20) with the developing roller 4.

Inside the toner accommodation chamber 18*b*, a stirring and transporting member 22 is provided. The stirring and transporting member 22 rotates in a direction indicated by arrow G in FIG. 2, and transports the toner to the upper portion of the toner supply roller 20 while stirring the toner accommodated in the toner accommodation chamber 18*b*. In the embodiment, the stirring and transporting member drives and rotates at 30 rpm.

A developing blade 8 is arranged beneath the developing roller 4, comes in contact with the developing roller 4 in its countering direction, controls a coated amount of the toner supplied by the toner supply roller 20, and applies charges to the toner. In the embodiment, a blade-spring-shaped SUS thin plate having a thickness of 0.1 mm is used as the developing blade 8, and the surface of the developing blade 8 comes in contact with the toner and the developing roller 4 using the spring elasticity of the thin plate. Here, the developing blade 8 may be formed in other configurations. For example, a metal thin plate formed of phosphor bronze, aluminum, or the like may be used. In addition, the surface of the developing blade 8 may be coated with a thin film formed of polyamide elastomer, urethane rubber, urethane resin, or the like.

In addition, the toner is charged by friction when the developing blade 8 and the developing roller 4 rub against each other, whereby charges are applied to the toner. At the same time, a thickness of a toner layer is controlled by the developing blade 8. In addition, in the embodiment, a prescribed voltage is applied from a blade bias power supply (not shown) to the developing blade 8 to stabilize a coated amount of the toner. In addition, in the embodiment, a bias applied to the developing blade 8 is set at −500 V.

In addition, the developing roller 4 serving as a developer bearing member and the photosensitive drum 1 rotate such that their mutual surfaces move in the same direction (direction from a lower side to an upper side in the embodiment) at a portion at which the developing roller 4 and the photosensitive drum 1 face each other. Note that the developing roller 4 is arranged in contact with the photosensitive drum 1 in the embodiment but may be arranged closely to the photosensitive drum 1 with a prescribed interval.

In the embodiment, the toner negatively charged by friction transfers only to the bright potential portion of the photosensitive drum 1 due to the potential difference between the photosensitive drum 1 and the developing roller 4 at a developing portion at which the photosensitive drum 1 serving as an image bearing member and the developing roller 4 contact each other. Thus, an electrostatic latent image is visualized as a toner image. In the embodiment, a voltage of −300 V is applied to the developing roller 4 such that the potential difference ΔV between the bright potential portion of the photosensitive drum 1 and the developing roller 4 becomes 200 V to form a toner image on the photosensitive drum 1.

In addition, the toner supply roller 20 and the developing roller 4 rotate in a direction in which the surfaces of the toner supply roller 20 and the developing roller 4 move from the upper end to the lower end of the nip portion. That is, the toner supply roller 20 rotates (clockwise) in a direction indicated by arrow E and the developing roller 4 rotates in a direction indicated by arrow D in FIG. 2. The toner supply roller 20 is an elastic sponge roller obtained by forming a foaming layer on the outer periphery of a conductive cored bar.

In addition, the toner supply roller 20 is pressed by the developing roller 4 to be depressed by ΔE. The toner supply roller 20 and the developing roller 4 rotate in opposite directions at the contact region at which the toner supply roller 20 and the developing roller 4 come in contact with each other. Thus, the toner is supplied from the toner supply roller 20 to the developing roller 4. At that time, it is possible to adjust an amount of the toner to be supplied to the developing roller 4 by the adjustment of the potential difference between the toner supply roller 20 and the developing roller 4. In the embodiment, the toner supply roller rotates at 80 rpm, and the developing roller rotates at 100 rpm. Further, a DC bias is applied to the toner supply roller 20 such that the toner supply roller 20 and the developing roller 4 have the same potential.

Note that in the embodiment, both the developing roller 4 and the toner supply roller 20 have an outer diameter of 15 mm. In addition, a depressed amount ΔE of the toner supply roller 20 when the toner supply roller 20 is pressed by the developing roller 4 is set at 1.0 mm. In addition, the heights of the centers of the toner supply roller 20 and the developing roller 4 are the same. Further, the toner supply roller 20 in the embodiment has a conductive support body and a foaming layer supported by the conductive support body. Specifically, the toner supply roller 20 has a cored bar electrode having an outer diameter φ of 5 mm as a conductive support body. In addition, in the toner supply roller 20, an urethane foaming layer serving as a foaming layer formed of a continuous foaming body (continuous foams) in which foams are connected to each other is provided around the cored bar electrode. In addition, the toner supply roller 20 rotates in the direction indicated by arrow E in FIG. 2.

Figure 12:
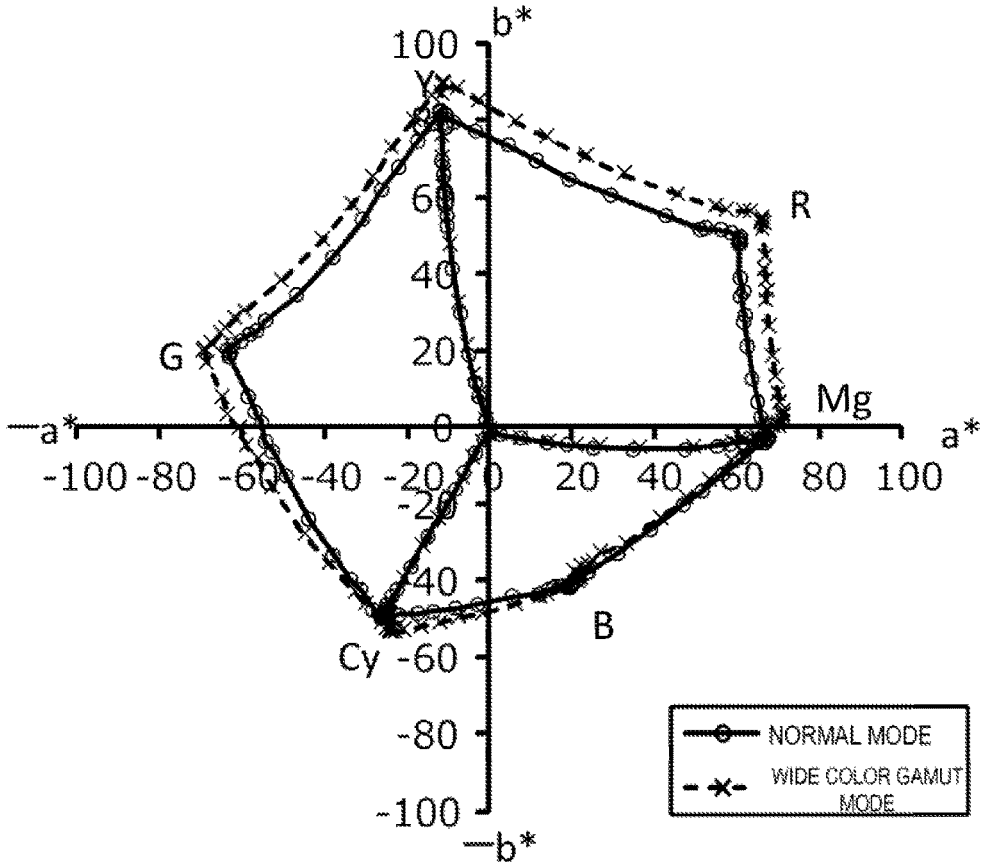
FIG. 12 is a diagram showing an example in which the color gamut of an image formed on a recording material expands.

In the embodiment, the image forming apparatus 100 is capable of performing an image forming mode A as a first image forming mode to perform image formation at normal image density. That is, the image forming mode A is so-called a normal mode. In addition, the image forming apparatus 100 is capable of performing an image forming mode B as a second image forming mode to form a high density image while increasing a tinge selection range (expanding a color gamut) by changing the peripheral speed ratio between the developing roller 4 and the photosensitive drum 1. Here, FIG. 12 is a diagram showing an example in which the color gamut of an image formed on the recording material 12 expands. As shown in FIG. 12, for example, the color gamut of the image does not partially decrease but increases as a whole in the embodiment. Specifically, the color gamut of yellow, red, magenta, cyan, and green increases. However, the gamut of blue does not greatly increase. It is possible to increase the color gamut of yellow (Y) and red (R) by 5% to 15%.

The comparison between the respective image forming modes indicates that the peripheral speed ratio between the photosensitive drum 1 and the developing roller 4 serving as a developer bearing member becomes different particularly when a black solid image is formed. In the image forming mode A representing the first image forming mode, the toner on the developing roller 4 transfers to the photosensitive drum 1 due to an electrical potential formed by a bias applied to the developing roller 4 and an electrostatic latent image formed on the photosensitive drum 1. On the other hand, in the image forming mode B representing the second image forming mode, a supply amount of the toner transferring from the developing roller 4 onto the photosensitive drum 1 increases with an increase in the peripheral speed ratio between the developing roller 4 and the photosensitive drum 1.

A description will be given in detail of a gamut expansion mode (image forming mode B) in which the gamut (expressible color range) of an image formed on the recording material 12 expands. In the embodiment, the photosensitive drum 1 rotates at 20 rpm in the image forming mode B (the photosensitive drum 1 rotates at 40 rpm in the image forming mode A). At this time, the developing roller 4 rotates at 100 rpm like the case of the image forming mode A. That is, in the image forming mode B, a peripheral speed of the photosensitive drum 1 is made slower than that of the photosensitive drum 1 in the image forming mode A to increase the peripheral speed difference between the photosensitive drum 1 and the developing roller 4. As a result, the peripheral speed ratio between the photosensitive drum 1 and the developing roller 4 (the speed ratio between the outer peripheral surfaces) is set at 156% (first peripheral speed ratio) in the image forming mode A but becomes 312% (second peripheral speed ratio) in the image forming mode B. That is, the peripheral speed ratio (second peripheral speed ratio) between the photosensitive drum 1 and the developing roller 4 in the image forming mode B is greater than that (first peripheral speed ratio) between the photosensitive drum 1 and the developing roller 4 in the image forming mode A. As a result, in the image forming mode B, an amount of the toner (developer) transferring from the developing roller 4 onto the photosensitive drum 1 when a solid black image is formed becomes twice as much as that of the image forming mode A. Thus, in the image forming mode B, it is possible to increase image density while expanding the gamut of an image formed on the recording material 12. Note that in the embodiment, the peripheral speed of the photosensitive drum 1 is set at 50 mm/sec and the peripheral speed of the developing roller 4 is set at 78.5 mm/sec in the image forming mode A. Here, in the embodiment, the "peripheral speed ratio" represents a value obtained by dividing a peripheral speed of the developing roller 4 by a peripheral speed of the photosensitive drum 1. That is, the peripheral speed ratio (%)=the peripheral speed of the developing roller 4/the peripheral speed of the photosensitive drum 1×100(%) is established. In addition, the "peripheral speed ratio" represents the peripheral speed ratio between the photosensitive drum 1 and the developing roller 4 at a portion at which the photosensitive drum 1 and the developing roller 4 contact each other. It is assumed that one direction at the portion at which the photosensitive drum 1 and the developing roller 4 contact each other is a forward direction. For example, when the photosensitive drum 1 and the developing roller 4 rotate in the same direction at the portion at which the photosensitive drum 1 and the developing roller 4 contact each other and have the same peripheral speed of 50 mm/sec, the peripheral speed ratio between the photosensitive drum 1 and the developing roller 4 becomes 100%. In addition, there is a case that the photosensitive drum 1 and the developing roller 4 rotate in opposite directions at the portion at which the photosensitive drum 1 and the developing roller 4 contact each other. In this case, when the photosensitive drum 1 has a peripheral speed of 50 mm/sec and the developing roller 4 has a peripheral speed of −50 mm/sec, the peripheral speed ratio between the photosensitive drum 1 and the developing roller 4 becomes −100%.

Here, in the embodiment, an image formed on the recording material 12 is digital. That is, in the embodiment, a multiplicity of the colors of dots gathers together to form an image. Further, in the embodiment, an amount of the toner consumed by one image is detected based on the number of dots (the number of pixels) by which the toner is consumed and an amount of the toner consumed by one dot (one pixel). For example, an amount of the toner consumed by one dot is stored in a storage portion 200 such as a memory in advance. Further, a CPU 53 serving as a control portion runs a programs stored in a ROM 54 to multiply the number of dots by which the toner is consumed by an amount of the toner consumed by one dot. Thus, an amount of the toner consumed by one image is detected. However, in order to detect toner consumption, it is also possible, for example, to combine together an optical transmission system residual toner amount detection method and a residual toner amount detection method using the number of dots by which an image is formed. However, in the embodiment, an amount of the toner consumed by one image is detected based on an amount of the toner consumed by one dot.

Specifically, in the embodiment, an amount of the toner consumed by one dot is as follows.

Image forming mode A: a (grams/dot)

Image forming mode B: b (grams/dot)

It is also possible to change the above values according to use environments (temperature and humidity). Here, when two or more image forming modes are provided like the embodiment, it is necessary to set in advance an estimate of the amount of the toner (developer) consumed by one dot for each of the plurality of modes. In the embodiment, the above values a and b are set in advance as estimates of the amounts of the toner consumed by one dot. Here, as will be described later, the estimates of the amounts of the toner consumed by one dot are stored in advance in the storage portion 200 such as a memory.

Note that estimates of the amounts of the toner consumed by one dot are stored in the storage portion 200 in the embodiment but may be stored in other ways. For example, the process cartridge 7 may have a memory to store estimates of the amounts of the toner consumed by one dot.

Figure 3:
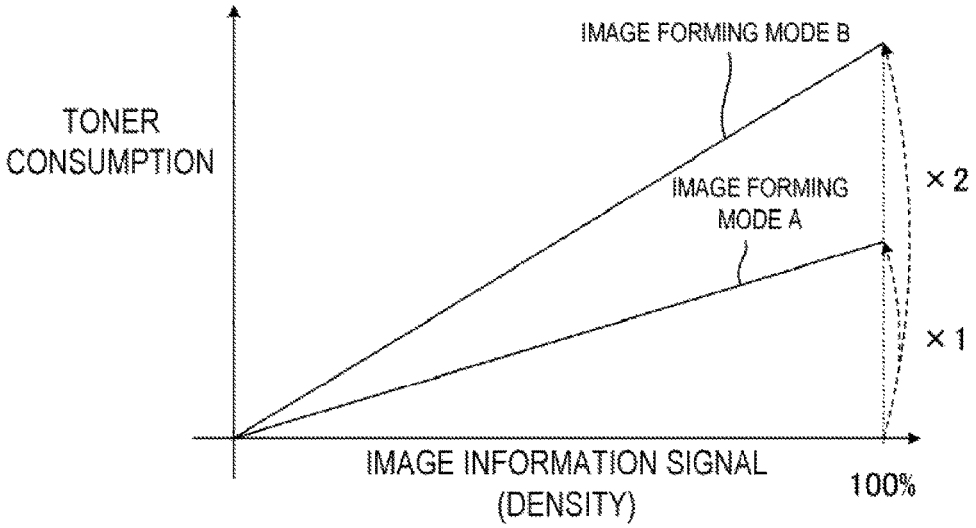
FIG. 3 is a diagram showing the relationship between an image information signal and toner consumption in the first embodiment.

In the embodiment, the peripheral speed ratio between the developing roller 4 serving as a developer bearing member and the photosensitive drum 1 serving as an image bearing member is set at 156% (first peripheral speed ratio) in the image forming mode A, and the peripheral speed ratio between the developing roller 4 and the photosensitive drum 1 is set 312% (second peripheral speed ratio) in the image forming mode B. Thus, an amount of the toner transferring from the developing roller 4 onto the photosensitive drum 1 becomes twice. Here, FIG. 3 is a diagram showing the relationship between toner consumption for forming one image and an image density signal received by the image forming apparatus 100. That is, an amount of the toner consumed by one dot in the image forming mode B becomes twice as much as that consumed by one dot in the image forming mode A. Therefore, the following relationship is established in the embodiment.

$$b=2\times a$$

Using the relationship, an estimate of the amount of the toner consumed by one dot is changed (made different) in the image forming mode A representing the first image forming mode and the image forming mode B representing the second image forming mode. Thus, it is possible to accurately detect toner consumption for forming one image in the image forming mode A and the image forming mode B. Thus, the image forming apparatus 100 according to the embodiment is allowed to alert a user to the absence of the toner ("the toner has been used up") in the developing unit 3 at an appropriate timing.

Figure 4:
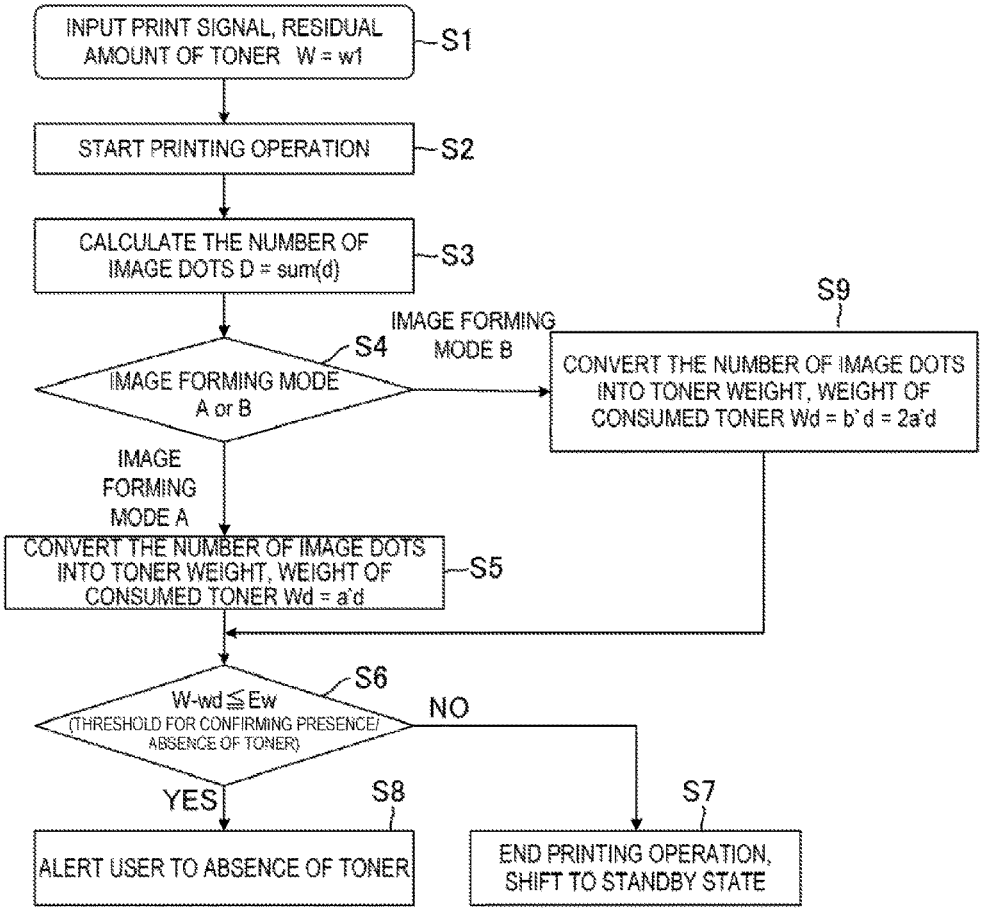
FIG. 4 is a flowchart showing the flow of detecting an amount of toner in the first embodiment.

FIG. 4 is a flowchart showing the flow of detecting a residual amount of the toner (residual amount of the developer) in the first embodiment. A description will be given, with reference to the flowchart shown in FIG. 4, in detail of the flow of determining the presence or absence of the toner inside the developing unit 3 serving as a developing apparatus. In the image forming apparatus 100, estimates of the amounts of the toner consumed by one dot are stored in the storage portion 200 such as a memory in advance. The number of dots (the number of pixels) by which the toner is consumed is derived based on an image information signal from a host 51 received by the image forming apparatus 100. Specifically, the CPU 53 serving as a control portion runs a program stored in the ROM 54 to divide a lighting time (lighting time for one image) of laser irradiated by the scanner unit 30 (exposure member) by a lighting time necessary for forming an electrostatic image of one dot. Thus, the number of dots by which the toner is consumed is calculated. The number of dots by which the toner is consumed is stored in the storage portion 200 such as a memory. Further, such information on dots is updated every time one image is formed. Here, in the embodiment, the storage portion 200 such as a memory and the ROM 54 are separately configured but may be configured in other ways. For example, the ROM 54 may have a function, as the storage portion 200, to store, in advance, estimates of the amounts of the toner consumed by one dot.

A description will be given of the flow with reference to the flowchart shown in FIG. 4. First, the processing proceeds to S2 when a print signal is input from the host 51 to the image forming apparatus 100 (YES in S1). At this time, a residual amount W=w1 of the toner inside the developing unit 3 has been acquired in a previous image forming operation and stored in the storage portion 200 of the image forming apparatus 100. After that, the image forming apparatus 100 starts an image forming operation, and the developing roller 4 rotates at an appropriate timing to form an electrostatic latent image on the photosensitive drum 1 serving as an image bearing member (S2).

Further, in S3, when the CPU 53 serving as a control portion runs a program stored in the ROM 54, the number d of dots by which the toner is consumed is acquired based on an image information signal received by the image forming apparatus 100 (S3). Further, in S4, the processing proceeds to S5 when the image forming apparatus 100 performs the image forming mode A. On the other hand, the processing proceeds to S9 when the image forming apparatus 100 performs the image forming mode B in S4.

Further, in S5, the CPU 53 runs the program stored in the ROM 54 to multiply an amount a (grams/dot) of the toner consumed by one dot by the number of dots (the number of pixels) by which the toner is consumed. Thus, an amount wd of the toner consumed by one image is calculated (S5). Further, the amount wd of the toner consumed in this image forming operation is subtracted from the residual amount W=w1 of the toner acquired in the previous image forming operation (before the image forming operation). Thus, a residual amount (W−wd) of the toner inside the developing unit 3 is acquired.

Next, in S6, the CPU 53 runs the program stored in the ROM 54 to compare the residual amount W−wd of the toner inside the developing unit 3 with a threshold Ew (S6). Here, the threshold Ew represents a threshold for determining whether the residual amount of the toner inside the developing unit 3 has been zero. Further, when the residual amount W−wd of the toner is greater than the threshold Ew (YES in S6), the image forming apparatus 100 ends the printing operation to shift to a standby state (S7). On the other hand, when the residual amount W−wd of the toner is less than or equal to the threshold Ew (NO in S6), a display is controlled to alert a user to the fact that the residual amount of the toner inside the developing unit 3 serving as a developing apparatus has been zero (S8).

Meanwhile, when the image forming apparatus 100 performs the image forming mode B (NO in S4), an amount wd of the toner consumed by one image is calculated with an assumption that an amount of the toner consumed by one dot is b (=2×a) (grams/dot) (S9). Further, the amount wd of the consumed toner is subtracted from the residual amount W=w1 of the toner after the previous image forming operation to compare the residual amount W−wd of the toner with the threshold Ew (S6). When the residual amount W−wd of the toner is greater than the threshold Ew, the image forming apparatus 100 ends the printing operation to shift to the standby state (S7). On the other hand, when the residual amount W−wd of the toner is less than or equal to the threshold Ew, the image forming apparatus 100 alerts the user to the fact that the residual amount of the toner inside the developing unit 3 has been zero (S8).

As described above, in the first embodiment, the image forming apparatus 100 is capable of performing the image forming mode A and the image forming mode B having the different peripheral speed ratios between the photosensitive drum 1 and the developing roller 4. In addition, the image forming apparatus 100 acquires an amount of the toner consumed in the image formation based on an estimate of the amount of the toner consumed by one dot and the number of dots at a part by which the toner is consumed. Further, the image forming apparatus 100 uses a different estimate of the amount of the toner consumed by one dot for each of the image forming mode A and the image forming mode B.

Thus, it is possible to accurately acquire toner consumption while increasing image quality.

Second Embodiment

Next, a description will be given of a second embodiment. Note that in the embodiment, portions having the same functions as those of the first embodiment will be denoted by the same symbols and their descriptions will be omitted. Here, in the embodiment, a lighting time of laser irradiated by the scanner unit 30 is changed besides performing dithering (image formation by dots) to express a multivalued image (image formed by three or more colors). Thus, it is possible to adjust gradation of the density of one pixel (basic pixel) constituting an image in a plurality of stages. Here, the "gradation" represents a degree of the concentration of pixels constituting a digital image. Specifically, a lighting time of laser is made different to change a time of irradiation of the photosensitive drum 1 by the laser or a region of the photosensitive drum 1 onto which the laser is irradiated. In the embodiment, PWM (Pulse Width Modulation method) is used to adjust gradation of the density of one pixel constituting an image. When an image is formed by the PWM, generally both resolution and gradation of the image (a degree of a change in the concentration of a color) become higher than a case in which the image is formed by the dithering.

Figure 5:
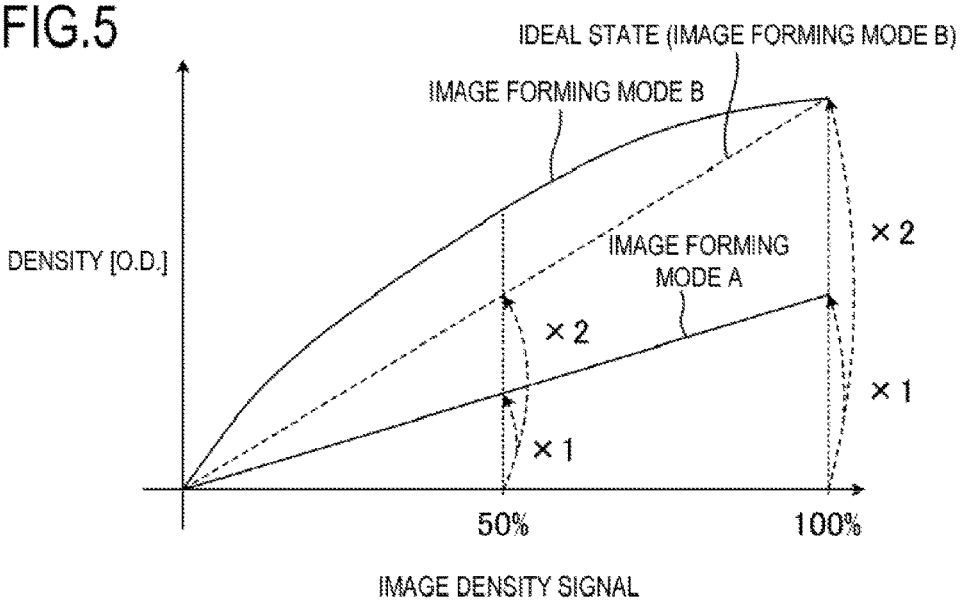
FIG. 5 is a diagram showing the relationship between an image density signal and optical density.
Figure 6:
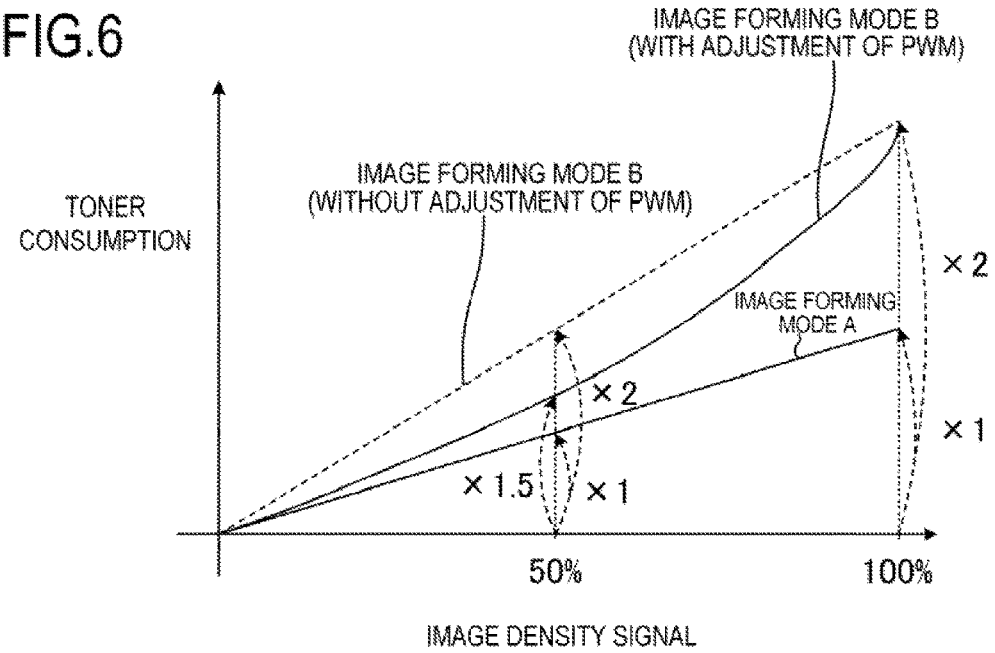
FIG. 6 is a diagram showing the relationship between the image density signal and the toner consumption when PWM control is implemented.

FIG. 5 is a diagram showing the relationship between an image density signal and optical density. In addition, FIG. 6 is a diagram showing the relationship between the image density signal and toner consumption when the PWM is used. When the image forming mode B is performed with the same setting as that of the image forming mode A, the relationship between the optical density (OD value) and the image density signal shown in FIG. 5 is obtained after the confirmation of gradation of an image. When the image density signal has the same value, the comparison of the toner consumption between the image forming mode A and the image forming mode B shows that toner consumption in the image forming mode B becomes twice as much as that in the image forming mode A as a matter of course.

Note that the image density signal is a signal showing density of an image formed on the recording material 12. When a solid black image is formed on the recording material 12, a value of the image density signal becomes 100%. Note that the image density signal may be calculated from the ratio of a laser irradiation time by the scanner unit 30 when a solid black image is formed to a laser irradiation time when the solid black image is not formed. Specifically, a laser irradiation time when an image is formed (printed) may be divided by a laser irradiation time when a black solid image is formed to calculate a degree of the image density signal.

Here, when it is assumed that a halftone image with intermediate gradation (for example, when a value of the image density signal is set at 50%) is printed on the entire surface of the recording material 12, the image is printed with the same setting as that of the image forming mode A. In this case, as shown in FIG. 5, the optical density (OD value) of the halftone image in the image forming mode B becomes twice or more as much as that in the image forming mode A. This is because an optical dot gain occurs (density of the image looks different from actual density due to the absorption and reflection of light). The sneak pass (diffraction) of the light causes an increase in the optical density of the halftone image.

Therefore, in order to prevent the image density with the intermediate gradation (halftone) from being higher than actual image density, the PWM is used in the embodiment. Specifically, when the image density signal has the same value, a laser irradiation time by the scanner unit 30 in the image forming mode B is made shorter than that in the image forming mode A. Thus, the relationship between the image density signal and the optical density (OD) is corrected to be linear also in the image forming mode B.

Further, since the relationship between the image density signal and the optical density (OD) is corrected by the PWM in the image forming mode B in the embodiment, the toner consumption decreases in the intermediate gradation. As a result, the relationship between the image density signal and the toner consumption shown in FIG. 6 is obtained. As shown in FIG. 6, when the image is printed in a state in which the image density signal has a value of 100%, the toner consumption in the image forming mode B becomes twice as much as that in the image forming mode A.

However, when the halftone image is printed in a state in which the image density signal has a value of 50%, the toner consumption in the image forming mode B becomes only 1.5 times as much as that in the image forming mode A.

Therefore, when it is assumed that the relationship between an amount b of the toner consumed by one dot in the image forming mode B and an amount a of the toner consumed by one dot in the image forming mode A is expressed as $b=A\times a$ (where A represents a constant value) like the first embodiment, it is not possible to accurately acquire a residual amount of the toner. In view of this problem, a value of an amount N of the toner consumed by one dot is made different according to a value of the image density signal as shown in FIG. 10. Note that the amount N of the toner is determined by calculating in advance the relationship between actual toner consumption and the image density signal through experiment. Further, a correspondence as shown in FIG. 10 is stored in advance in the storage portion 200 such as a memory. Further, in the embodiment, toner consumption for each range of the image density signal is acquired, and a total of the toner consumption is regarded as an amount of the toner consumed by one image.

Figure 7:
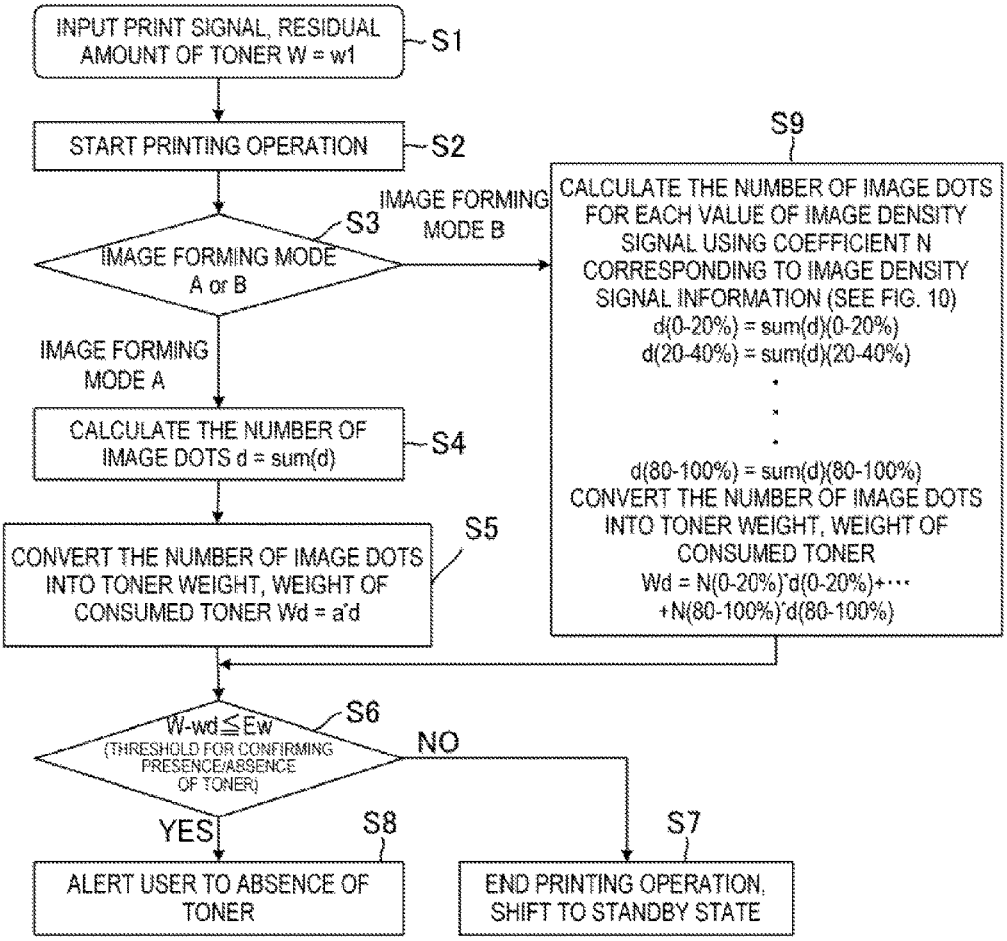
FIG. 7 is a flowchart showing the flow of detecting a residual amount of the toner in a second embodiment.

FIG. 7 is a flowchart showing the flow of detecting a residual amount of the toner in the second embodiment. A description will be given, with reference to FIG. 7, in detail of the flow of a method for acquiring a residual amount of the toner in the embodiment. In the embodiment as well, the CPU 53 runs a program stored in the ROM 54 to control the operation of a device inside the image forming apparatus 100 like the first embodiment. In the embodiment, the image forming apparatus 100 stores in advance the correspondence (see FIG. 10) between the amount N of the toner consumed by one dot and the image density signal in the storage portion 200 such as a memory.

In addition, in the embodiment, as shown in FIG. 10, the image density signal is divided into five ranges in increments of 20%, and the number of dots by which the toner is consumed is acquired for each of the five ranges of the image density signal. Further, the number of dots by which the toner is consumed is stored in the storage portion 200 such as a memory. However, the number of dots by which the toner is consumed may be stored in other ways. For example, it may be possible to divide the recording material 12 into some regions and store the number of dots by which the toner is consumed and an average of the values of the image density signal for each of the regions in the storage portion 200.

In FIG. 7, first, the processing proceeds to S2 when a print signal is input from the host 51 to the image forming apparatus 100 (YES in S1). At this time, a residual amount W=w1 of the toner acquired in a previous image forming operation has been stored in the storage portion 200 inside the image forming apparatus 100. After that, in S2, the image forming apparatus 100 starts an image forming operation, and the developing roller 4 rotates at an appropriate timing to form an electrostatic latent image on the photosensitive drum 1 (S2). In S3, the image forming apparatus 100 determines which one of the image forming mode A and the image forming mode B is to be performed (S3). The processing proceeds to S4 when the image forming apparatus 100 performs the image forming mode A (YES in S3). On the other hand, the processing proceeds to S9 when the image forming apparatus 100 performs the image forming mode B (NO in S3).

Further, in S4, the number d of dots by which the toner is consumed is acquired in the same manner as that of the first embodiment (S4). Next, in S5, an amount a of the toner consumed by one dot is multiplied by the number d of dots by which the toner is consumed to acquire an amount wd of the toner consumed by one image (S5). Further, the amount wd of the toner may be subtracted from the residual amount W=w1 of the toner after the previous image forming operation to acquire a residual amount (w1−wd) of the toner inside the developing unit 3 after this image forming operation. After that, when the residual amount W−wd of the toner is greater than a threshold Ew, the image forming apparatus 100 ends the image forming operation to shift to a standby state (NO in S6). On the other hand, when the residual amount W−wd of the toner is less than or equal to the threshold Ew, the image forming apparatus 100 alerts a user to the fact that the residual amount of the toner inside the developing unit 3 serving as a developing apparatus has been zero ("the toner has been used up") (S8).

Here, in the embodiment, when the image forming apparatus 100 performs an image forming operation in the image forming mode B, the number d of dots by which the toner is consumed is acquired for each of the five ranges of the image density signal as described above. For each of the five ranges of the image density signal, the amount N (grams/dot) (see FIG. 10) of the toner consumed by one dot is multiplied by the number d of dots. Further, by the integration of the toner consumption acquired for the five respective ranges of the image density signal, an amount wd of the toner consumed by one image is acquired.

After that, in S6, the amount wd of the consumed toner is subtracted from the residual amount W=w1 of the toner to compare a residual amount W−wd of the toner with the threshold Ew (S6). When the residual amount W−wd of the toner is greater than the threshold Ew, the image forming apparatus 100 ends the image forming operation to shift to the standby state (No in S6, S7). On the other hand, when the residual amount W−wd of the toner is less than or equal to the threshold Ew, the image forming apparatus 100 alerts the user to the fact that the residual amount of the toner inside the developing unit 3 has been zero ("the toner has been used up") (YES in S6, S8).

In the embodiment, the image density signal is divided into some ranges in increments of 20%, and the amount N of the toner consumed by one dot is set for each of the ranges. However, the image density signal is not necessarily divided into ranges at even intervals. For example, in a range of the image density signal in which toner consumption changes greatly, the image density signal may be segmentalized. In addition, the curve shown in FIG. 6 may be stored in the storage portion 200 in advance to calculate toner consumption.

As described above, in the embodiment, it is possible to accurately acquire toner consumption while increasing image quality like the first embodiment.

In addition, in the embodiment, since an image is formed by the PWM, both resolution and gradation of an image (a degree of a change in the concentration of a color) become higher than those of a case in which an image is formed by the dithering.

Third Embodiment

In a third embodiment, based on a measurement result of a colorimeter that measures optical density (OD value), an amount of the toner consumed by one dot is corrected such that optical density of an image printed on the recording material 12 becomes appropriate. Further, when such a correction is performed, an amount of the toner consumed by one image also changes. Therefore, in the embodiment, an estimate of the amount of the toner consumed by one dot is changed so as to correspond to the correction. Thus, it is possible to accurately acquire an amount of the toner consumed by one image. Here, in the third embodiment, portions having the same functions as those of the second embodiment will be denoted by the same symbols and their descriptions will be omitted.

Figure 8:
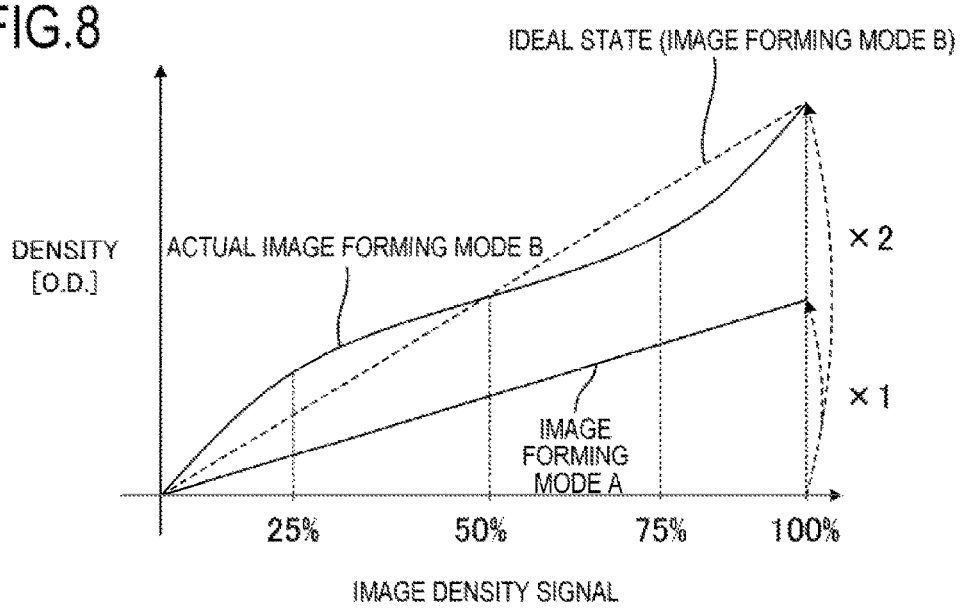
FIG. 8 is a diagram showing the relationship between the optical density and the image density signal in a third embodiment.
Figure 9:
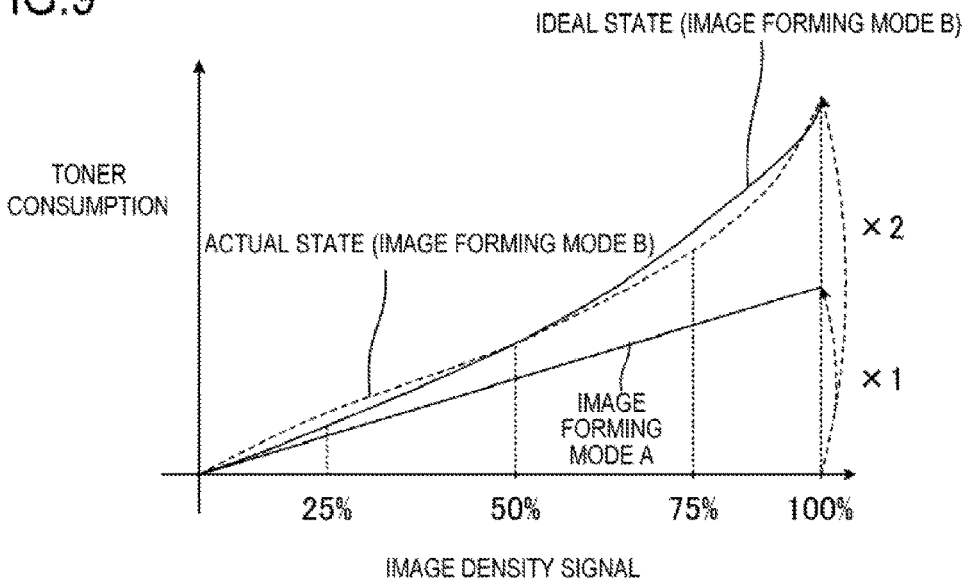
FIG. 9 is a diagram showing the relationship between the toner consumption and the image density signal in the third embodiment.

Here, FIG. 8 is a diagram showing the relationship between the optical density of a printed image and the image density signal in the third embodiment. In addition, FIG. 9 is a diagram showing the relationship between an amount of the toner consumed by one image and the image density signal in the third embodiment. In the embodiment, an image is formed by the PWM in the image forming mode B like the second embodiment. Here, the relationship between the optical density of the image and the image density information is ideally preferably expressed as dashed lines shown in FIG. 8. However, the optical density actually measured by the colorimeter is expressed as a solid line shown in FIG. 8. That is, the relationship between the optical density and the image density information is not expressed as a line.

Therefore, in the embodiment, an amount of the toner consumed by one dot is corrected in order to obtain the relationship between the optical density and the image density information expressed as the dashed lines shown in FIG. 8. By the correction, the relationship between the optical density and the image density information expressed as the dashed lines in FIG. 8 is obtained. Specifically, in the embodiment, patch images in which values of the image density signal are set at 25%, 50%, 75%, and 100% are printed in advance. Further, optical density of the patch images is measured by the colorimeter, and the amount of the toner consumed by one dot is corrected based on the measured optical density.

However, when the amount of the toner consumed by one dot is corrected, an amount of the toner consumed by one image also changes. Here, in FIG. 9, the relationship between the amount of the toner consumed by one image and the image density information is ideally preferably expressed as a solid line in FIG. 9. However, the relationship between the amount of the toner consumed by one image and the image density information is actually expressed as dashed lines shown in FIG. 9. Therefore, an estimate of the amount of the toner consumed by one dot is changed so as to correspond to the correction. Specifically, as shown in FIG. 11, an estimate N of the amount of the toner consumed by one dot is each set so as to correspond to the image density information divided into four ranges.

Further, in the embodiment, the correspondence shown in FIG. 11 is stored in the storage portion 200 such as a memory. Here, in the embodiment, a conversion formula is stored in the storage portion 200, and an estimate of the amount of the toner consumed by one dot is changed by the conversion formula so as to correspond to the correction. Thus, the correspondence shown in FIG. 11 is derived. In the embodiment, an amount of the toner consumed by one image is calculated using the correspondence shown in FIG. 11. Thus, it is possible to accurately acquire an amount of the toner consumed by one image. Note that the third embodiment is the same as the second embodiment except that an estimate N of the amount of the toner consumed by one dot is changed.

As described above, in this embodiment, it is possible to accurately acquire toner consumption while increasing image quality like the first embodiment.

In addition, in this embodiment, based on a measurement result of the colorimeter that measures the optical density (OD value), an amount of the toner consumed by one dot is corrected such that optical density of an image printed on the recording material 12 becomes appropriate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-030184, filed on Feb. 19, 2016, which is hereby incorporated by reference herein in its entirety.

What is claimed is:

1. An image forming apparatus comprising:

an image bearing member on which an electrostatic image is formed;

a developer bearing member configured to bear a developer to develop the electrostatic image formed on the image bearing member;

an updating device configured to update toner consumption based on a number of dots corresponding to laser irradiation by which toner is consumed; and an alerting device configured to alert an alarm concerning a residual amount of the toner based on the toner consumption updated by the updating device, wherein the image forming apparatus is capable of operating in a first mode in which the image forming apparatus performs image formation at a first peripheral speed ratio representing a ratio of a peripheral speed of the developer bearing member to a peripheral speed of the image bearing member, and in a second mode in which the image forming apparatus performs image formation at a second peripheral speed ratio, which is greater than the first peripheral speed ratio, wherein the alerting device alerts the alarm based on a total number of dots based on the number of dots corresponding to laser irradiation by which toner is consumed, the total number of dots being smaller as an operation frequency of the second mode becomes higher than an operation frequency of the first mode.

2. The image forming apparatus according to claim 1, wherein the alerting device alerts the alarm based on the total number of dots, which is smaller, as compared to a case where the operation frequency of the second mode is lower than the operation frequency of the first mode, when the operation frequency of the second mode is higher than the operation frequency of the first mode.

3. The image forming apparatus according to claim 1, wherein the alerting device alerts the alarm based on the total number of dots, which is greater, as compared to a case where the operation frequency of the second mode is higher than the operation frequency of the first mode, when the operation frequency of the second mode is lower than the operation frequency of the first mode.

4. The image forming apparatus according to claim 1, wherein a drive source configured to drive the image bearing member is different from a drive source configured to drive the developer bearing member.

5. The image forming apparatus according to claim 1, wherein a plurality of developer bearing members are provided, and a plurality of image bearing members are provided, wherein at least one of the developer bearing members corresponds to a predetermined color and at least one of the image bearing members corresponding to the predetermined color is commonly driven by a first drive source, wherein a plurality of developer bearing members corresponding to two or more colors other than the predetermined color are commonly driven by a second drive source, and wherein a plurality of image bearing members corresponding to two or more colors other than the predetermined color are commonly driven by a third drive source.

6. The image forming apparatus according to claim 5, wherein the predetermined color is black.

* * * * *